US005309722A

United States Patent [19]

Phillips, Jr.

[11] Patent Number: 5,309,722

[45] Date of Patent: May 10, 1994

[54] TEMPERATURE CONTROL SYSTEM FOR LIQUID NITROGEN REFRIGERATOR

[75] Inventor: Harry L. Phillips, Jr., Fairhope, Ala.

[73] Assignee: Harsco Corporation, Wormleysburg, Pa.

[21] Appl. No.: 972,904

[22] Filed: Nov. 6, 1992

[51] Int. Cl.[5] ..... F25D 25/00; F25D 17/02

[52] U.S. Cl. ..... 62/49.1; 62/49.2; 62/52.1; 62/62; 62/64; 62/373

[58] Field of Search ..... 62/49.1, 49.2, 52.1, 62/62, 64, 373, 374, 376

[56] References Cited

U.S. PATENT DOCUMENTS

| | | | |
|---|---|---|---|
| 2,445,294 | 7/1948 | Nelson | 62/373 X |
| 2,951,351 | 9/1960 | Snelling | 62/373 X |
| 3,368,361 | 2/1968 | Rietdijk | 62/373 X |
| 4,388,814 | 6/1983 | Schilling | 62/62 |
| 4,537,034 | 8/1985 | Crouch | 62/62 |
| 4,667,478 | 5/1987 | Jones, III | 62/52.1 X |
| 4,723,420 | 2/1988 | Sitte | 62/373 X |
| 4,726,195 | 2/1988 | Klee | 62/62 |
| 4,739,622 | 4/1988 | Smith | 62/49.1 X |
| 4,888,956 | 12/1989 | le Roux Murray | 62/64 X |
| 4,934,151 | 6/1990 | Shima | 62/52.1 X |

OTHER PUBLICATIONS

Operating and Maintenance Instructions 8K and 17K Cryo-Storage Systems-Taylor-Wharton Cryogenics.

*Primary Examiner*—Henry A. Bennet
*Assistant Examiner*—C. Kilner
*Attorney, Agent, or Firm*—Kerkam, Stowell, Kondracki & Clarke

[57] ABSTRACT

The temperature differential in the vapor-phase storage area of a liquid nitrogen refrigerator is reduced by producing turbulence in the nitrogen gas in the vapor-phase storage area without materially affecting the level of liquid nitrogen in the refrigerator. In one embodiment, turbulence is induced by introducing gaseous nitrogen into the refrigerator chamber near or below the level of the liquid nitrogen. In another embodiment, an atomized spray of liquid nitrogen is injected adjacent the top of the refrigerator chamber to absorb heat from the warmer nitrogen gas and to produce turbulence or circulation in the nitrogen gas in the chamber. In another embodiment, a gas circulating fan is provided in the top of the refrigeration chamber, with the fan being operated in response to a signal indicating that the temperature has reached a predetermined high level at a critical point in the chamber.

6 Claims, 2 Drawing Sheets

TEMPERATURE CONTROL SYSTEM FOR LIQUID NITROGEN REFRIGERATOR

BACKGROUND OF THE INVENTION

1. Field of the Invention

This invention relates to liquid nitrogen refrigeration systems, and more particularly to an improved temperature control system for maintaining the desired temperature in a liquid nitrogen refrigerator above the level of the liquid nitrogen refrigerant.

2. Description of the Prior Art

Liquid nitrogen refrigeration systems are well known and widely used for the cryogenic storage of biological specimens and other materials and for industrial or other uses where very low temperatures are required. Such refrigerators conventionally employ a cylindrical stainless steel vacuum insulated inner container defining the specimen storage and the liquid nitrogen refrigerant compartment, with an insulated lid or door providing access to the interior of the refrigerator from the top. Liquid nitrogen is admitted into the bottom of the insulated chamber and specimens to be stored are inserted through the lid.

The level of liquid nitrogen in a typical liquid nitrogen refrigerator is maintained by a liquid level controller that opens a solenoid actuated valve when the liquid level falls below a predetermined low level, and closes the valve when the level reaches the predetermined high level whereby a supply of liquid nitrogen is continuously maintained in the bottom of the chamber. Depending upon the nature of the specimens, storage may be either in the "liquid phase" wherein the specimens are submerged in liquid nitrogen, in which case the liquid nitrogen level is maintained near the top of the chamber, or in the "vapor phase" above the surface of the liquid nitrogen in the inner container, in which case the liquid nitrogen level is maintained at a relatively low level. The temperature of the liquid nitrogen is, as known, constant at −196° C. whereas the temperature of the gaseous nitrogen above the liquid will vary from −196° C. at the liquid-vapor interface to a substantially higher temperature which, for vapor-phase storage, may be within the vicinity of −100° C. to −120° C. directly beneath the closed refrigerator lid.

Ideally, for vapor-phase storage, the temperature within the specimen storage area would be maintained substantially uniform at or below the required storage temperature. In the past the accepted way of reducing the temperature in the top area of the storage space was to raise the level of liquid nitrogen in the inner container. By raising the liquid level, however, specimens stored in the lower level space would be submerged in liquid nitrogen which may not be acceptable.

One method to improve the temperature differential in the vapor-phase storage area has been to install a heat conductive device in the form of an aluminum cylinder or sleeve adjacent the inner surface of the inner container. To be most effective, the sleeve should extend through the specimen storage area. It may or may not extend into the liquid nitrogen depending on the storage temperature required. Such conductive sleeves are only partially effective in reducing the temperature gradient in the vapor-phase storage area, and do not by themselves assure that the desired temperature is maintained. It is, accordingly, an object of the present invention to provide an improved method of and apparatus for providing automatic temperature control in the vapor-stage storage area of a liquid nitrogen refrigerator cryogenic storage system while maintaining the level of the liquid nitrogen within a desired or acceptable range.

Another object is to provide such a method and apparatus for reducing the temperature differential between the upper and lower regions of the vapor-phase storage area by producing turbulence in the gaseous nitrogen above the liquid nitrogen refrigerant in the bottom of the refrigerator.

Another object is to provide such an improved liquid nitrogen refrigerator in which the admission of nitrogen into the refrigerator container is controlled to produce turbulence in the vapor-phase to thereby provide a more uniform temperature throughout the vapor-phase storage area.

SUMMARY OF THE INVENTION

In the attainment of the foregoing and other objects and advantages of the invention, an important feature resides in continuously monitoring the temperature within the refrigerator storage chamber adjacent the top of the vapor-phase storage area and producing turbulence in the gaseous nitrogen to thereby reduce the temperature differential between the upper and lower levels in response to the sensed temperature reaching a predetermined level. In a preferred embodiment, this is accomplished by employing the sensed temperature to control the admission of nitrogen into the refrigerator storage compartment in a manner to produce turbulence in the vapor-phase area while maintaining the level of liquid nitrogen within the desired range.

An electronic controller is employed to control actuation of valve means in response to temperature signals from the temperature sensing device and to control the level of liquid in response to level sensors located one each at the low and high level locations within the container. In accordance with one embodiment, when the temperature sensor senses a temperature above a predetermined level in the upper area of the chamber, the electronic controller pulses a valve which admits liquid nitrogen into a warm, or uninsulated transfer conduit where the liquid nitrogen is quickly vaporized into nitrogen gas which is permitted to flow into the refrigeration chamber to be discharged below the level of the liquid nitrogen in the bottom of the container. This gas flow continues for a relatively short time during which the gaseous nitrogen creates turbulence in the liquid nitrogen and stirs the vapors in the specimen storage area causing the temperature at the upper region of the storage space to be reduced. This procedure is repeated at periodic intervals, as required, until the temperature at the temperature sensor adjacent the top of the vapor-phase storage area drops below the predetermined maximum level.

In an alternate embodiment, liquid nitrogen is admitted at the top of the vapor-phase storage area in the form of a fine spray. The atomized droplets of liquid nitrogen absorb heat from the warmer vapors and are vaporized, or partially vaporized to quickly reduce the temperature in the upper region of the vapor-phase compartment. Simultaneously, the admission of the spray produces turbulence in the vapor which tends to equalize the temperature throughout the vapor-phase storage area. Again, liquid nitrogen spray is admitted only in short pulses to avoid undesired raising of the liquid level in the bottom of the refrigerator.

In a further embodiment, an electric motor driven fan is mounted on the lower surface of the refrigerator door or lid, and the electric controller provides power to the fan motor to drive the fan in response to the temperature reaching a predetermined level.

BRIEF DESCRIPTION OF THE DRAWINGS

The foregoing and other features and advantages of the invention will be apparent from the detailed description contained hereinbelow, taken in conjunction with the drawings, in which.

DESCRIPTION OF THE PREFERRED EMBODIMENTS

Figure 1:
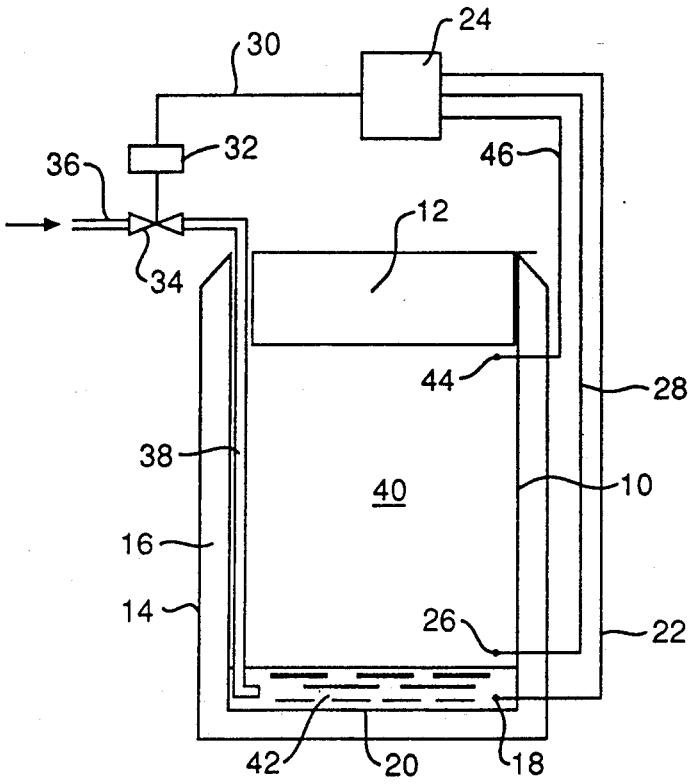
FIG. 1 (PRIOR ART)
FIG. 1 is a schematic vertical sectional view of a prior art commercial liquid nitrogen refrigerator.

Referring now to the drawings in detail, a commercial liquid nitrogen cryogenic storage system, or refrigerator, such as that manufactured by Taylor-Wharton Cryogenics of Theodore, Ala. is schematically illustrated in FIG. 1. This known refrigerator comprises a high strength stainless steel cylindrical container or vessel 10 having an open top normally closed by a hinged, insulated door or lid 12. A larger cylindrical metal jacket 14 surrounds vessel 10 in outwardly spaced relation thereto, with jacket 14 having its top sealed to the open top of vessel 10, and the space 16 between the vessel 10 and jacket 14 is evacuated to provide thermal insulation for the inner vessel 10.

A low level liquid sensor 18 is supported within vessel 10 at a location above the bottom wall 20 and determines the minimum level of liquid nitrogen for proper operation of the refrigerator. Low level sensor 18 is connected through suitable electrical conductors indicated at 22 to an electronic controller 24. A high level liquid sensor 26 is also positioned within the vessel at a location to determine or limit the maximum level of liquid nitrogen desired for operation. High level sensor 26 is connected through electrical conductors 28 to controller 24 which, in turn, is connected through suitable electrical conductors 30 to the solenoid 32 of a solenoid actuated valve 34 connected in a low pressure liquid nitrogen supply line indicated generally at 36.

Valve 34 has its outlet connected to a fill tube 38 which extends into the vessel 10 through a suitably sealed recess in the peripheral edge of top lid 12 to admit liquid nitrogen into the interior refrigeration chamber 40 defined by vessel 10. Fill tube 38 has its outlet located adjacent to the bottom wall 20 and preferably below low level sensor 18 so that liquid nitrogen flowing into the refrigerator will be discharged below the level of the liquid nitrogen refrigerant, indicated at 42, in the bottom of the vessel 10.

It is also known from the prior art to provide a temperature sensor, or thermocouple 44 within the chamber 40 at a location immediately beneath the bottom surface of lid 12 to continuously measure the temperature of the nitrogen gas at this area. This temperature signal is supplied, through conductor 46, to controller 24 which is programmed to provide a visual and/or audible signal when the temperature at the location of the thermocouple 44 rises above a predetermined safe level determined by the nature of the specimens stored.

In operation of the prior art refrigerators just described with regard to FIG. 1, liquid nitrogen is admitted through the fill tube 38 until the level of the liquid reaches the high level sensor 26 in the bottom of the container. Specimens to be stored in the refrigerator are placed in suitable storage racks inserted into the vapor-phase storage space 40 between the bottom surface of the lid and the maximum level of liquid nitrogen as determined by the position of upper liquid level sensor 26. With the lid 12 closed, the liquid nitrogen refrigerant 42 continuously vaporizes to fill the vapor-phase storage space 40 with gaseous nitrogen to chill the specimens to the desired cryogenic temperature. The liquid nitrogen will continue to vaporize until the top surface reaches the low level sensor 18 at which time controller 24 will reopen the valve 34 to admit more liquid nitrogen to the bottom of the chamber, raising the liquid nitrogen level to upper level sensor 26, at which time the valve 34 will be closed. This cycling is continued throughout operation of the refrigerator.

As is known, in the prior art liquid nitrogen refrigerators of the type just described, the temperature within the vapor stage specimen storage area 40 will vary from the temperature of liquid nitrogen, i.e., −196° C., at the liquid-gas interface to a high temperature which may be as high as −100° C. adjacent the bottom surface of the lid 12. This high temperature within chamber 40 will, of course, vary to some extent depending upon the depth of the chamber, loading conditions, and the like, and it is known to adjust the position of the high and low liquid level sensors to maintain a higher level of liquid nitrogen in the bottom of the chamber to thereby lower the temperature in the top of the storage space. In this regard, the upper and lower level sensors are normally mounted in a tube extending along the wall of the vessel 10 and means are provided for raising or lowering the position of the sensors within the tube as necessary or desired.

While raising the level of liquid nitrogen in storage space 40 will reduce the temperature at the top of the chamber, there are limits to which this expedient may be employed since it may not be acceptable to have the liquid nitrogen reach a level at which specimens in the bottom of the chamber would be submerged.

As indicated previously, one known method of reducing the temperature differential from the bottom to the top of the vapor-phase storage space is to provide a metallic sleeve around the inner peripheral area of the vessel, with the sleeve being formed from a metal having a high thermal conductivity coefficient. Such conducting sleeves reduce the temperature at the top by absorbing heat from the warmer areas and conducting the heat downwardly to the colder area above the liquid nitrogen. Such systems have been constructed which will reduce the temperature within the area of the temperature sensor or thermocouple 44 by as much as 30° C. However, for many installations, the use of such inserts or sleeves within the refrigeration compartment is undesirable and may not be effective in reducing the temperature differential to the extent desired or necessary for long term specimen storage.

Figure 2:
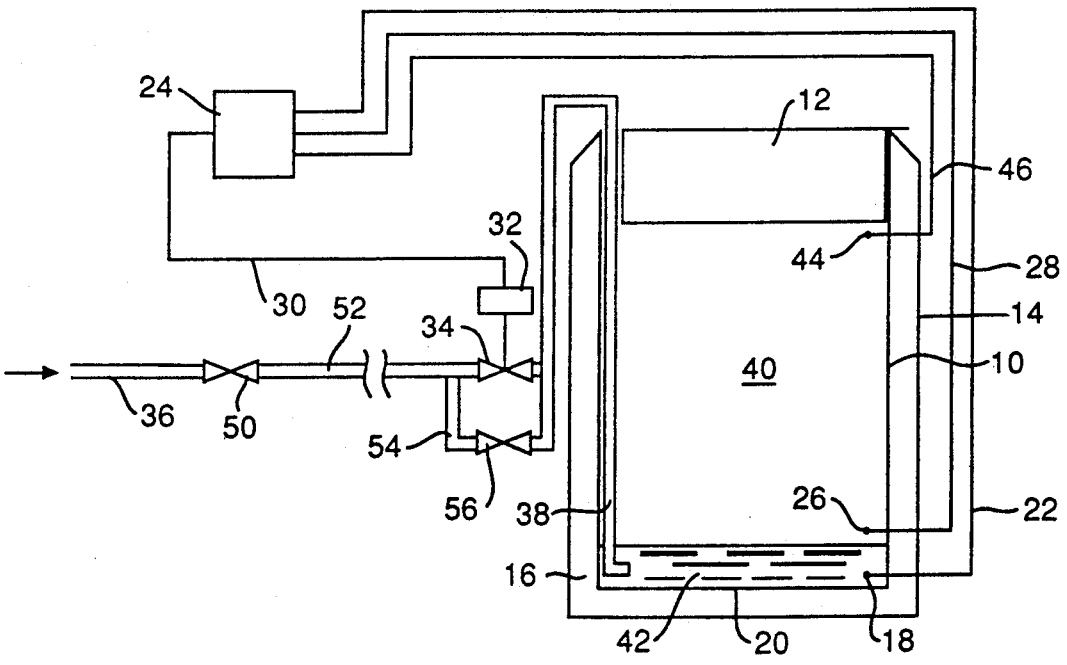
FIG. 2 is a view similar to FIG. 1 and schematically showing a vapor-phase temperature control system in accordance with the present invention.

Referring now to FIG. 2, one arrangement according to the present invention for reducing the temperature differential in the vapor-phase storage compartment of a liquid nitrogen refrigerator will be described. In all embodiments illustrated in the drawings, the construction of the refrigeration compartment are substantially as described above and accordingly like reference numerals are employed to designate like parts throughout the drawings. Thus, in FIG. 2, the liquid nitrogen from the low pressure source is fed through conduit 36 through a one-way check valve 50 having its outlet connected to an uninsulated metallic tube or conduit 52 leading to the solenoid actuated valve 34 which, as described above, has its outlet connected to the fill tube 38. A bypass conduit 54 is connected around solenoid valve 34, and a pressure relief valve 56 is connected in bypass 54. The liquid level sensors are set to control the maximum and minimum liquid nitrogen levels as described above, and the temperature sensor 44 is preferably located substantially at the level of the top layer of specimens to be stored whereby the maximum temperature of the specimens can continuously be monitored.

With the system on and operating, the controller 24 will open the solenoid valve 34 when the level of nitrogen falls below the low level sensor and the valve will remain open until the liquid reaches the high level sensor as described above with regard to the prior art refrigerator. However, when the thermocouple 44 senses a temperature above a predetermined or preset level, controller 24 will pulse solenoid valve 34 open for a prescribed short period, typically from about 5 up to about 30 seconds, then close the valve for a predetermined minimum time. During the short valve opening, liquid nitrogen flows past the check valve 50 into the relatively warm, uninsulated transfer conduit 52 where it absorbs heat from the conduit and quickly vaporizes into nitrogen gas which flows through valve 34 and through the fill tube 38 to be discharged as gas below the surface of the liquid nitrogen body 42. The discharge of gaseous nitrogen creates turbulence at the liquid surface which stirs the vapors in the specimen storage area 40 causing the temperature at the top to be reduced.

When solenoid valve 34 is closed, check valve 50 traps liquid and nitrogen gas in the transfer tube 52. As heat is absorbed, the pressure in the trapped nitrogen will rise rapidly, until pressure in transfer tube 52 overcomes the bias of pressure relief valve 54 to again discharge pressurized gas into the reservoir of liquid nitrogen, again producing turbulence during the vaporous nitrogen in the specimen storage chamber.

Typically, pressure in the liquid nitrogen supply line 36 is relatively low and may be about 22 psig, while the pressure relief valve 56 may be set to open at a higher pressure of, for example, about 35 psig so that when the pressure relief valve closes, nitrogen gas remaining within the transfer tube will be at a pressure greater than that of the liquid nitrogen supply, thereby retaining check valve 50 closed. During this time, the chilled uninsulated transfer tube will quickly absorb heat from the ambient atmosphere. If desired, or necessary, means may also be provided to supply heat from an external source to the conduit section 52.

Controller 24 is programmed to continue to pulse solenoid valve 34 to admit gaseous nitrogen below the liquid nitrogen surface until the temperature falls below the maximum temperature setting at the level of the thermocouple 44. By controlling the pulsed on and off cycles so that essentially all liquid nitrogen entering the tube 52 is gasified, the pulsing will not materially affect the level of liquid nitrogen in the refrigerator. However, when the level falls below the low level sensor, valve 34 is retained open until liquid level flows through the fill tube to again raise the liquid level until it again reaches the high level sensor. During this fill cycle, an initial injection of gaseous nitrogen will, of course, be admitted but the liquid nitrogen quickly chills the tube 52 so that liquid nitrogen then flows through valve 34. Again, at the close of this cycle, liquid nitrogen trapped in the uninsulated tube 52 will vaporize from heat absorbed from the ambient surroundings, with the gaseous nitrogen being admitted through pressure relief valve 56 and fill tube 38 to be discharged below the level of the liquid nitrogen in the refrigerator.

The bubbling of gaseous nitrogen through the liquid nitrogen in the refrigerator results in the added gas being at a temperature very close to that of the liquid nitrogen. Thus, the cold nitrogen gas tends to force the warmer gas in the top of the chamber to escape, again contributing to the reduction in the temperature differential from bottom to top in the chamber.

Figure 3:
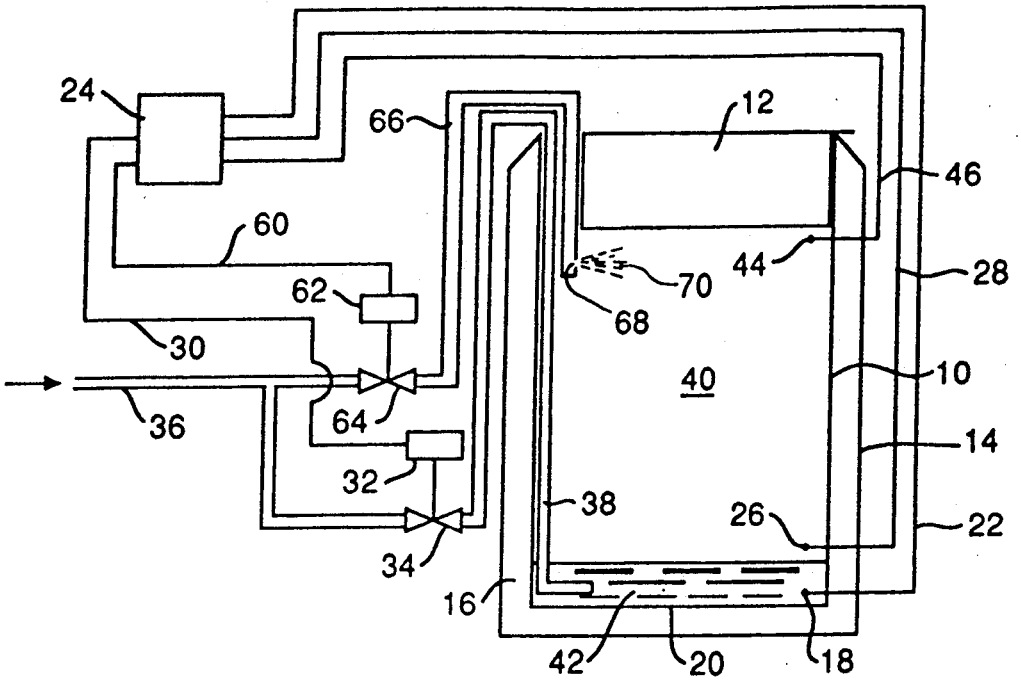
FIG. 3 is a view similar to FIGS. 1 and 2 and showing an alternate embodiment of the invention.

Referring now to FIG. 3, an embodiment of the invention is illustrated in which liquid nitrogen admitted into the refrigerator is employed to reduce the temperature in the upper regions of the vapor-phase storage chamber without materially affecting the level of liquid nitrogen in the bottom of the refrigerator. In this embodiment, controller 24 is connected through line 60 to the solenoid 62 of a second solenoid actuated valve 64 having its inlet connected to the low pressure liquid nitrogen supply line 36. Valve 64 has its outlet connected to a conduit 66 which extends into the vapor-phase storage compartment 40 in a manner similar to the fill tube 38, with conduit 66 terminating in an atomizing nozzle 68 positioned to direct an atomized spray 70 of liquid nitrogen droplets transversely of the storage chamber closely adjacent the bottom surface of lid 12. Operation of valve 64 is independent of the liquid nitrogen fill valve 34 and is controlled in response to a signal from thermocouple 44 to the controller 24 indicating that the temperature at the thermocouple level (again preferably the level of the top specimen stored within the chamber) has reached a predetermined level. When such a high temperature is sensed, controller 24 pulses opens valve 64 for a predetermined brief interval to inject an atomized spray 70 of liquid nitrogen. The fine droplets of liquid nitrogen absorb heat from and are vaporized by the warmer gaseous nitrogen adjacent the top of the storage chamber. In addition to cooling the nitrogen gas by absorption of heat, the velocity of the spray creates turbulence in the gas in the chamber which also tends to equalize the temperature throughout the gas-phase storage area. By admitting the nitrogen at the top of the chamber in the form of an atomized spray which is discharged for brief intervals, as required, until the thermocouple 44 senses the desired low temperature, again the bottom to top temperature differential is reduced without materially affecting the level of liquid gas in the bottom of the refrigerator.

Figure 4:
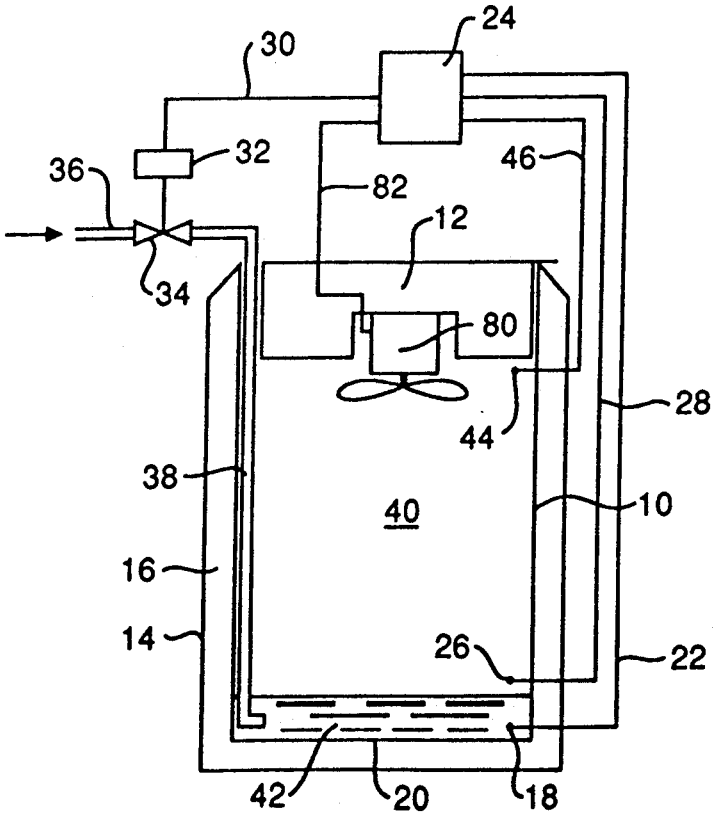
FIG. 4 is a view similar to FIGS. 1–3 and showing a further embodiment of the invention.

A further embodiment of the invention is illustrated in FIG. 4 wherein a small electrically operated fan 80 mounted on the under surface of lid 12 is connected through line 82 to the controller 24. In this embodiment, when thermocouple 44 senses a temperature above a predetermined maximum desired temperature, controller 24 provides current through line 82 to fan 80 which is driven to create turbulence or circulate the nitrogen gas within the chamber 40. In this embodiment of the invention, it is essential that the fan 80 not be exposed to excessive moisture condensate which can accumulate when the lid 12 is open. Thus, this embodiment is more suitable for use in liquid nitrogen refrigerators employed to store specimens for long periods of time without the refrigerator being opened.

It should be apparent that various changes could be made in the construction and operation of the liquid nitrogen refrigerator system while utilizing the inventive concept. For example, instead of bubbling nitrogen gas through the liquid nitrogen refrigerant, the gas could be discharged above the surface of the liquid nitrogen in a manner to produce the desired turbulence in the vapor-phase storage area. Accordingly, while preferred embodiments of the invention have been disclosed and described, it is intended to include all embodiments of the invention which would be apparent to one skilled in the art and which come within the spirit and scope of the invention.

What is claimed:

1. A liquid nitrogen refrigerator in which materials may be stored in a nitrogen gas atmosphere of a vapor-stage storage area above a body of liquid nitrogen having a top free surface including a refrigeration chamber having a closed bottom and an open top normally closed by a door, a fill tube having an outlet adjacent the bottom of the refrigeration chamber for admitting liquid nitrogen into the chamber below the level of the top free surface of the body of liquid nitrogen, high and low level sensors in the chamber to sense the level of liquid nitrogen and produce a signal in response to the liquid nitrogen reaching predetermined high and low levels, conduit means connecting a supply of liquid nitrogen to the fill tube through a power operated valve, and a controller responsive to signals from the high and low level sensors for actuating the power operated valve to maintain the liquid nitrogen in the chamber between an upper and a lower level determined by the high and low level sensors, the improvement comprising:

temperature sensing means in the refrigeration chamber for sensing the temperature at a predetermined location above the top free surface of the body of liquid nitrogen and producing a signal representative of the temperature sensed, and gas temperature control means responsive to said temperature sensing means for producing turbulence in the nitrogen gas atmosphere in the chamber when the sensed temperature exceeds a predetermined level to thereby reduce the temperature of the gaseous nitrogen atmosphere at said predetermined location, said gas temperature control means including means providing a supply of nitrogen gas, means connecting said supply of nitrogen gas to said fill tube for admission into the refrigeration chamber below the top free surface of the body of liquid nitrogen to thereby produce turbulence in the nitrogen gas atmosphere of the vapor-phase storage area, said means providing a supply of nitrogen gas including means for gasifying nitrogen from the liquid nitrogen supply, said fill tube discharging said gasified nitrogen below the surface of liquid nitrogen in the refrigeration chamber.

2. A liquid nitrogen refrigerator in which materials may be stored in a nitrogen gas atmosphere in a vapor-stage storage area above a body of liquid nitrogen having a top free surface, including a refrigeration chamber having a closed bottom and an open top normally closed by a door, a fill tube having an outlet adjacent the bottom of the refrigeration chamber for admitting liquid nitrogen into the chamber below the level of the top free surface of the body of liquid nitrogen, high and low level sensors in the chamber to sense the level of liquid nitrogen and produce a signal in response to the liquid nitrogen reaching predetermined high and low levels, conduit means connecting a supply of liquid nitrogen to the fill tube through a power operated valve, and a controller responsive to signals from the high and low level sensors for actuating the power operated valve to maintain the liquid nitrogen in the chamber between an upper and a lower level determined by the high and low level sensors, the improvement comprising, temperature sensing means in the refrigeration chamber for sensing the temperature at a predetermined location above the top free surface of the body of liquid nitrogen and producing a signal representative of the temperature sensed, second conduit means connected to the supply of liquid nitrogen and extending into said chamber, a second power operated valve connected to said second conduit means, a spray nozzle connected to said second conduit within said chamber at a location adjacent said door, and gas temperature control means responsive to said temperature sensing means for producing turbulence in the nitrogen gas atmosphere in the chamber when the sensed temperature exceeds a predetermined level to thereby reduce the temperature of the gaseous nitrogen atmosphere at said predetermined level, said temperature control means being operable in response to a signal from said temperature sensing means to open and close said second power operated valve to admit a pulse of liquid nitrogen to flow through said second conduit means and discharged as an atomized spray in the nitrogen gas atmosphere adjacent the top of the chamber whereby the atomized spray of liquid nitrogen absorbs heat of vaporization from the warmer nitrogen gas atmosphere adjacent the top of said chamber to produce turbulence and reduce the temperature differential in the nitrogen gas in the atmosphere throughout the chamber, said pulse of liquid nitrogen being of sufficiently short duration as to be substantially completely vaporized in the gaseous nitrogen atmosphere whereby the level of liquid nitrogen in the chamber is not effected by said atomized spray.

3. A method of controlling the temperature in the storage area of a liquid nitrogen refrigerator in which materials may be stored in a nitrogen gas atmosphere in a vapor-stage storage area above a body of liquid nitrogen having a top free surface, the refrigerator including a refrigeration chamber having a closed bottom and an open top normally closed by a door, a fill tube having an outlet adjacent the bottom of the refrigeration chamber for admitting liquid nitrogen into the chamber below the level of the top free surface of the body of liquid nitrogen, a liquid nitrogen conduit connecting a supply of liquid nitrogen to the fill tube through a power operated valve, and a liquid nitrogen controller responsive to signals from a high level and a low level liquid nitrogen sensor in the chamber for actuating the power operated valve to maintain the liquid nitrogen level in the chamber within a range determined by the high and low level sensors, the improvement wherein said method comprises sensing the temperature in the refrigerator at a predetermined level above the top free surface of the liquid nitrogen and producing a signal representative of the temperature sensed, and inducing turbulence in the nitrogen gas atmosphere in the chamber in response to a sensed temperature exceeding a predetermined level by gasifying liquid nitrogen from the liquid nitrogen supply, admitting the gasified nitrogen into the fill tube, and discharging the gaseous nitrogen below the free surface of the liquid nitrogen in the chamber to thereby produce turbulence in the liquid nitrogen and in the nitrogen gas atmosphere thereabove to thereby produce a more uniform temperature throughout the storage area.

4. A method of controlling the temperature in the storage area of a liquid nitrogen refrigerator in which materials may be stored in a nitrogen gas atmosphere in a vapor-stage storage area above a body of liquid nitrogen having a top free surface, the refrigerator including a refrigeration chamber having a closed bottom and an open top normally closed by a door, a fill tube having an outlet adjacent the bottom of the refrigeration chamber for admitting liquid nitrogen into the chamber below the level of the top free surface of the body of liquid nitrogen, a liquid nitrogen conduit connecting a supply of liquid nitrogen to the fill tube through a power operated valve, and a liquid nitrogen controller responsive to signals from a high level and a low level liquid nitrogen sensor in the chamber for actuating the power operated valve to maintain the liquid nitrogen level in the chamber within a range determined by the high and low level sensors, the improvement wherein said method comprises sensing the temperature in the refrigeration chamber at a predetermined level above the top free surface of the liquid nitrogen and producing a signal representative of the temperature sensed, providing a second conduit connected to the supply of liquid nitrogen and extending into said chamber, providing a second power operated valve connected in the second conduit, providing a spray nozzle on the end of the second conduit within said chamber at a location adjacent the door, and opening and closing the second power operated valve in response to signals from the sensed temperature to admit pulses of liquid nitrogen to flow through the second conduit and nozzle and be discharged as an atomized spray into the nitrogen gas atmosphere adjacent the top of the chamber whereby the atomized spray of liquid nitrogen absorbs heat of vaporization from the warmer nitrogen gas atmosphere adjacent the top of the chamber to produce turbulence in the nitrogen gas atmosphere in the vapor-stage storage area of the chamber and reduce the temperature differential in the nitrogen gas in the atmosphere throughout the chamber, said pulse of liquid nitrogen being of sufficiently short duration as to be substantially completely vaporized in the gaseous nitrogen atmosphere whereby the level of liquid nitrogen in the chamber is not effected by said atomized spray.

5. The liquid nitrogen refrigerator defined in claim 1 wherein said conduit means comprises a section of conduit normally maintained at a temperature above the temperature of liquid nitrogen, and wherein the controller responsive to signals from the high and low level liquid sensor further comprises said temperature control means and is operable in response to a signal from the temperature sensor to pulse the power operated valve open to permit a predetermined volume of liquid nitrogen to flow into said section of conduit whereby heat absorbed from said section of conduit gasifies the pulse of liquid nitrogen.

6. The method defined in claim 3 wherein the step of gasifying liquid nitrogen comprises providing an uninsulated section of the liquid nitrogen supply conduit and normally maintaining said uninsulated section pulsing the pulsing the power operated valve open to permit a predetermined volume of liquid nitrogen to flow into the section of uninsulated conduit whereby heat absorbed from the section of conduit gasifies the predetermined volume of liquid nitrogen and permitting the nitrogen gas to flow into the chamber through the fill tube.

* * * * *